United States Patent [19]

Uchikata

[11] Patent Number: 4,976,557

[45] Date of Patent: Dec. 11, 1990

[54] SHEET CONVEYING DEVICE WITH AXIALLY DISENGAGED TRANSMITTER OF RESTRAINING FORCE

[75] Inventor: Yoshio Uchikata, Yokohama, Japan

[73] Assignee: Canon Kabushiki Kaisha, Tokyo, Japan

[21] Appl. No.: 471,069

[22] Filed: Jan. 29, 1990

Related U.S. Application Data

[63] Continuation of Ser. No. 170,687, Mar. 14, 1988, abandoned, which is a continuation of Ser. No. 829,485, Feb. 14, 1986.

[30] Foreign Application Priority Data

Feb. 20, 1985 [JP] Japan ..... 60-030481

[51] Int. Cl.[5] ..... B41J 19/78

[52] U.S. Cl. ..... 400/565; 400/567; 400/568

[58] Field of Search ..... 400/545, 555, 556, 556.2, 400/559, 559.1, 560, 560.1, 562, 563, 564, 565, 566, 566.1, 567, 568, 569, 577, 902

[56] References Cited

U.S. PATENT DOCUMENTS

| | | | |
|---|---|---|---|
| 1,027,391 | 1/1912 | Raber | 400/577 |
| 2,000,651 | 5/1935 | Sherman | 400/564 X |
| 2,203,024 | 6/1940 | Lewis et al. | 400/559.1 X |
| 2,831,559 | 4/1958 | Riffert . | |
| 3,272,303 | 9/1966 | Pohl . | |
| 3,618,738 | 11/1971 | Boyatt . | |
| 3,820,646 | 6/1974 | Lombardi . | |
| 3,880,016 | 4/1975 | Jamieson et al. | 74/405 |
| 3,915,281 | 10/1975 | Blomquist et al. . | |
| 3,935,938 | 2/1976 | Hodne . | |
| 4,049,069 | 8/1977 | Kwan et al. . | |
| 4,195,940 | 4/1980 | Rekewitz | 400/568 |
| 4,247,212 | 1/1981 | Wu | 400/559.1 X |
| 4,383,778 | 5/1983 | Costa | 400/569 |
| 4,494,887 | 1/1985 | Wincent | 400/568 |

FOREIGN PATENT DOCUMENTS

| | | | |
|---|---|---|---|
| 0038216 | 10/1981 | European Pat. Off. . | |
| 2758148 | 5/1979 | Fed. Rep. of Germany . | |
| 66005089 | 5/1981 | Fed. Rep. of Germany . | |
| 3122985 | 12/1982 | Fed. Rep. of Germany . | |
| 159377 | 9/1984 | Japan | 400/577 |
| 190876 | 10/1984 | Japan | 40/568 |
| 215884 | 12/1984 | Japan | 400/568 |
| 18370 | 1/1985 | Japan | 400/577 |
| 811015 | 3/1959 | United Kingdom . | |
| 1280445 | 7/1972 | United Kingdom . | |
| 1282558 | 7/1972 | United Kingdom . | |
| 1489792 | 10/1977 | United Kingdom . | |
| 2026949 | 2/1980 | United Kingdom . | |
| 2139149A | 11/1984 | United Kingdom . | |

OTHER PUBLICATIONS

IBM Technical Bulletin, vol. 19, No. 8, "Stepping-Motor Stop Control" pp. 2974–2975.

IBM Technical Bulletin, vol. 17, No. 4 "Electromechanical Variable-Index System", pp. 959–960.

*Primary Examiner*—David A. Wiecking

*Attorney, Agent, or Firm*—Fitzpatrick, Cella, Harper & Scinto

[57] ABSTRACT

A sheet conveying device provided with a detent mechanism and capable of effecting automatic feeding of the shet by the use of a drive source and also capable of effecting feeding of the sheet by manual operation, the sheet conveying device including a rotational member for conveying a sheet, a drive source for driving the rotational member, a drive transmitting device for transmitting the drive force of the drive source to the rotational member to rotate the rotational member by the drive force of the drive source, a manual operating member for manually driving the rotational member, a detent device producing a rotation restraining force, a restraining force transmitting device for transmitting the restraining force from the detent device, and apparatus for connecting and disconnecting the restraining force transmitting device and the drive transmitting device.

6 Claims, 4 Drawing Sheets

SHEET CONVEYING DEVICE WITH AXIALLY DISENGAGED TRANSMITTER OF RESTRAINING FORCE

This application is a continuation of application Ser. No. 170,687 filed Mar. 14, 1988 now abandoned which is a continuation of 06/829,485 filed Feb. 14, 1986, now abandoned.

BACKGROUND OF THE INVENTION

1. Field of the Invention

This invention relates to a sheet conveying device applied in an image recording apparatus such as a printer, an electronic typewriter, an ink jet printer or a word processor. More particularly, the present invention relates to a sheet conveying device which is capable of automatic feeding and manual feeding of a sheet and in which, during automatic feeding, the detent force is not applied to a driving element as a load.

The word "sheet" used herein includes, for example, typewriting paper on which recording such as printing is effected, recording paper for word processors, and a transparent plastic sheet for an overhead projector (OHP).

2. Description of the Related Art

The conventional sheet feeding mechanism provided with a detent mechanism has adopted a structure in which a gear as the detent mechanism is provided on a paper feeding portion, for example, a platen shaft, and in which a ratchet is brought into mesh engagement with this gear.

When sheet feeding is to be effected by a motor or the like, the platen shaft is rotated by the motor. Thus, the gear integral with the shaft is rotated and the ratchet is disengaged from the gear over the teeth of the gear, so that sheet feeding is accomplished.

The provision of a detent mechanism is for the purpose of effecting click rotation relative to the rotation of the platen and also for causing the platen to be rotated by a predetermined pitch in accordance with the pitch determined by the pitch of the teeth of the gear of the detent mechanism, thereby enabling accurate sheet feeding to be accomplished.

In such a structure, the ratchet engages the gear integral with the platen shaft and acts in conjunction with the loads of the platen and the recording sheet urged against the platen by a pinch roller, so that the positioning of the platen may be effected. Therefore, the force needed to cause the ratchet to engage with the gear must increase as the rigidity of the recording sheet is increased.

Also, when sheet feeding is by motor, a load to feed the recording sheet and to cause the ratchet to be disengaged from the gear, i.e. over the teeth of the gear, is required, and this calls for a more expensive motor of increased output.

Furthermore, there has been a problem that the sheet feeding speed is reduced in order to increase the reduction gear ratio of a set of gears for transmitting the drive force.

As a means for solving such disadvantages, there has been proposed a structure in which a solenoid for moving the ratchet is provided, with so that when sheet feeding is to be effected by the motor, the ratchet is pulled apart from the gear. However, as previously mentioned, the force for causing the ratchet to engage with the gear is great, thus the solenoid for pulling the ratchet apart from the gear has also requires a great output. This has led to a problem that the device becomes bulky and costly.

SUMMARY OF THE INVENTION

It is an object of the present invention to provide a sheet conveying device which can accurately accomplish conveyance of a sheet.

It is another object of the present invention to provide a sheet conveying device which can convey a sheet in a predetermined direction.

It is still another object of the present invention to provide a sheet conveying device which is simple in structure.

It is yet still another object of the present invention to provide a sheet conveying device of the energy saving type.

It is a further object of the present invention to provide a sheet conveying device which is capable of automatic sheet feeding and manual sheet feeding and in which, during automatic sheet feeding, the detent force does not provide a load.

It is still a further object of the present invention to provide a sheet conveying device which is capable of automatic sheet feeding and manual sheet feeding and in which the detent force acts only during manual sheet feeding.

A sheet conveying device according to the present invention has a rotational member for conveying the sheet; a drive source for driving said rotational member; drive transmitting means for transmitting a drive force of said drive source to said rotational member to rotate said rotational member by the drive force of said drive source; a manual operating member for manually driving said rotational member; detent means producing a rotation restraining force; restraining force transmitting means for transmitting the restraining force from said detent means; and connecting-disconnecting means for connecting and disconnecting said restraining force transmitting means and said drive transmitting means.

In another aspect, the sheet conveying device according to the present invention has a rotational member for conveying the sheet; a drive source for driving said rotational member; drive transmitting means for transmitting the drive force of said drive source; a manual operating member for manually driving said rotational member; detent means producing a rotation restraining force; restraining force means for transmitting the restraining force from said detent means; and change-over means for selecting the drive force by said drive transmitting means.

In still another aspect, the sheet feeding mechanism according to the present invention, a drive force from a sheet feeding motor is transmitted to a platen through a group of gears and a detent mechanism is interposed in a part of said group of gears. The mechanism is characterized in that a gear for transmitting a rotation restraining force from said detent mechanism to said group of gears is provided for sliding movement while being normally urged in a drive force transmitting direction by a spring, and said gear is designed so as to be separable from a drive force transmitting gear system.

DESCRIPTION OF THE PREFERRED EMBODIMENTS

The present invention will hereinafter be described in detail with respect to some embodiments thereof.

Figure 1:
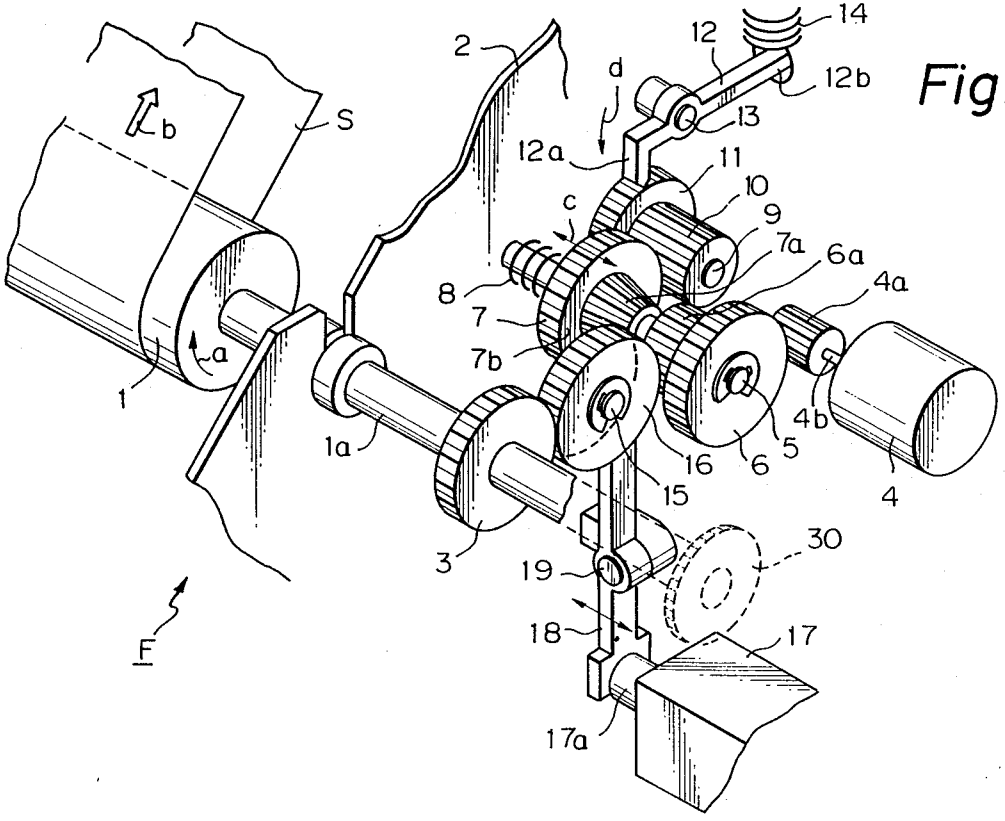
FIG. 1 is a perspective view of a sheet conveying device to which an embodiment of the present invention is applied.
Figure 2:
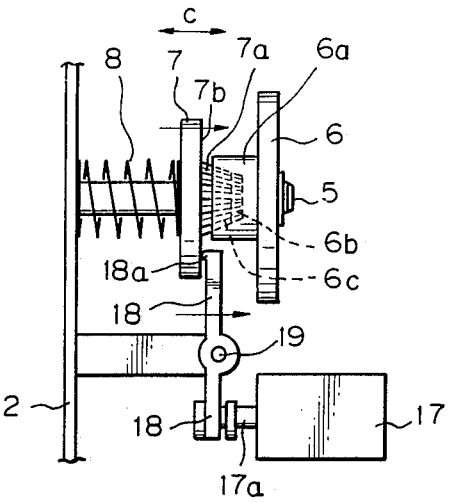
FIG. 2 is a side view showing the state of the same device during manual sheet feeding.
Figure 3:
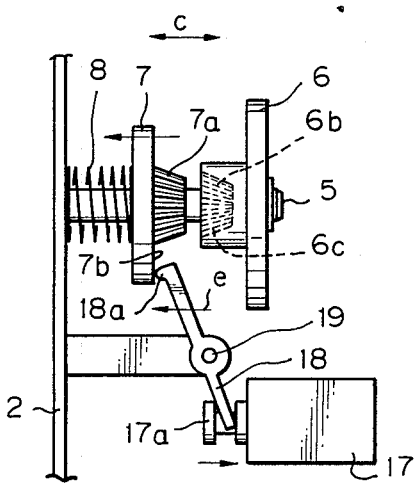
FIG. 3 is a side view showing the state of the same device during automatic sheet feeding.

FIG. 1 is a perspective view of a sheet conveying device to which an embodiment of the present invention is applied, FIG. 2 is a side view showing the state thereof during manual sheet feeding, and FIG. 3 is a side view showing the state thereof during automatic sheet feeding.

In FIG. 1, reference numeral 1 designates a platen rotatably supported on the left and right side plates 2 of the device F by a platen shaft 1*a*. A gear 3 is fixed to one end of the platen shaft 1*a* outside the side plate 2 of the device F. A manually operated knob 30 which will later be described is secured to the platen shaft 1*a* further outside the base plate 2. The platen 1 is a roller made of rubber and conveys a sheet S in a predetermined direction (the direction of arrow b) by being rotated (in the direction of arrow a).

A group of gears 4*a*, 6, 6*a* and 16 for transmitting the drive force from a motor 4 are disposed near the gear 3.

The motor 4 is fixed to the frame (not shown) of the device with its output shaft 4*b* being parallel to the platen shaft 1*a*.

The gear 4*a* is fixed to the output shaft 4*b* of the motor 4 and is in mesh engagement with the gear 6 supported on a shaft 5 extending from the side plate 2 and parallel to the platen shaft 1*a*.

A pinion gear 6*a* is formed integrally with the gear 6.

A frusto-conical space 6*c* (as shown in FIGS. 2 and 3), gradually reduced in diameter toward the gear 6 is formed inside the pinion gear 6*a*, and a serration 6*b* is formed on the inner peripheral surface of the space 6*c*.

Also, a gear 7 is fitted for rotation and sliding movement (in the directions of bilateral arrow c) on the shaft 5 inside the gear 6 and the side plate 2.

The gear 7 is biased toward the gear 6 by a spring 8 wound around the shaft 5 between the gear 7 and the side plate 2.

A frusto-conical serration portion 7*a* is formed integrally with the side 7*b* of the gear 7 which is adjacent to the gear 6.

This serration portion 7*a* is in mesh engagement with the serration 6*b* formed on the inner peripheral surface of the pinion gear 6*a*.

On the other hand, the gear 7 is in mesh engagement with a gear 10 rotatably supported on the side of the side plate 2 through a shaft 9.

A detent gear 11 is formed integrally with the gear 10, and above this detent gear 11, a detent lever 12 is supported for rotation relative to the side plate 2 by a shaft 13.

One end of the detent lever 12 provides a ratchet 12*a* which can mesh with the teeth of the detent gear 11.

A spring 14 is extended between the other end 12*b* of the detent lever 12 and the upper portion of the side plate 2, and the detent lever 12 is biased in counterclockwise direction (the direction of arrow d) as viewed in FIG. 1 by the spring 14.

On the other hand, the pinion gear 6*a* integral with the gear 6 is in mesh engagement with a gear 16 rotatably supported on the side plate 2 by a shaft 15, and the gear 16 in turn is in mesh engagement with the gear 3 fixed to one end of the platen shaft 1*a*.

A solenoid 17 is fixed below the above-described group of gears, and the lower end of a pivotable lever 18 is pivotably connected to the end of the rod 17*a* of the solenoid 17.

The intermediate portion of the pivotable lever 18 is pivotably supported on the fixed portion of the device through a shaft 19, and a bulged portion 18*a* is formed on the upper end portion of the pivotable lever 18, as shown in FIGS. 2 and 3. This bulged portion 18*a* is in contact with the side 7*b* of the gear 7 which is adjacent to the gear 6.

Operation of the present embodiment construction as described above will now be described.

First, where sheet feeding is to be effected by manually rotating the platen 1, the supply of electric power to the solenoid 17 is cut off as shown in FIG. 2.

In this state, the rod 17*a* is in its extended position, the pivotable lever 18 is in its substantially vertical position, the gear 7 is moved toward the gear 6 by the resilient force of the spring 8, and the serration portion 6*b* and the serration portion 7*a* are in mesh engagement with each other.

In this state, the gears shown in FIG. 1 are all in mesh engagement with one another.

That is, a drive transmitting system (motor 4→ gear 4*a*→gear 6→pinion gear 6*a*→gear 16→gear 3) for transmitting the drive force of the motor 4 to the platen 1 to rotate the platen 1 by the drive force of the motor 4 is connected to a restraining force transmitting system (detent lever 12 →gear 10 →gear 7) for transmitting a rotation restraining force produced by the detent lever 12.

The ratchet 12*a* of the detent lever 12 is lowered by the force of the spring 14 and meshes with the teeth of the detent gear 11.

In this state, of course, the supply of electric power to the motor 4 is cut off.

In such a state of manual operation, the rotation restraining force of the ratchet 12*a* of the detent lever 12 relative to the detent gear 11 is transmitted to the gear 3 integral with the platen shaft 1*a*, through the gears 10, 7, 6*a* and 16 which are in mesh engagement with one another. The platen 1 cannot be rotated unless the force of the spring 14 is overcome and the platen shaft 1*a* is rotated through the intermediary of the knob 30.

That is, the platen 1 is positioned in a predetermined position.

So, where the platen 1 is to be rotated to effect feeding of the sheet S by manual operation, if the knob 30 is grasped by fingers and such a degree of rotational force that the ratchet 12*a* rides over the detent gear 11 against the force of the spring 14 is imparted to the knob 30, the platen 1 will be click-rotated in response to the manual operation and the recording sheet S can be conveyed in the predetermined direction at a predetermined pitch.

In this manner, in the case of manual feeding, feeding of the sheet S can be accomplished by rotating the platen 1 at a predetermined pitch determined by the pitch of the teeth of the detent gear 11.

On the other hand, where automatic feeding of the sheet S is to be effected by the utilization of the motor 4, the motor 4 is operated and the solenoid 17 is operated. The operation of the motor 4 and the solenoid 17 can be accomplished by a signal produced by a return key or a line feed key being depressed, or a signal produced when a line feed code is detected during the processing.

When the solenoid 17 is operated, the rod 17*a* is retracted as shown in FIG. 3 and the pivotable lever 18 is rotated in a counter-clockwise direction (in the direction of arrow e).

As a result, the upper end portion of the pivotable lever 18 pushes the outer side 7*b* of the gear 7 by the bulged portion 18*a* and therefore, the spring 8 flexes and the gear 7 is moved toward the side plate 2.

As a result, the serration portions 6*b* and 7*a* separate from each other and the gear 6 becomes disengaged from the gear 7.

In this state, the rotation restraining force of the ratchet 12*a* of the detent lever 12 through the detent gear 11 is not transmitted to the gear 3 on the platen shaft 1*a*.

The revolution of the motor 4 is transmitted to the gear 3 through the pinion gear 4*a*, the gear 6 and the gear 16, and the platen 1 is rotated in conformity with the revolution of the motor 4, whereby desired feeding of the sheet S can be accomplished.

Where such automatic sheet feeding utilizing the motor is effected, the rotation restraining force of the ratchet 12*a* of the detent lever 12 is absent and therefore, the load of the group of gears as a whole is very small. So, even if the output of the motor 4 is not so great, the platen 1 can be rotated and a very compact, inexpensive motor of a small output can be chosen.

The present invention is not restricted to the above-described embodiment. For example, in the absence of electric power being supplied to the solenoid 17, the pivotable lever 18 can be manually pivoted to thereby separate the gear 7 and the gear 6 from each other. Also in the case of manual sheet feeding, the rotation restraint by the detent gear 11 and the ratchet 12*a* can be eliminated, whereby the platen 1 can be rotated to accomplish sheet feeding by a slight force.

The device of the present invention can also be used in such a special state of use, but when the pivotable lever 18 is returned to its original position and the serration portions 7*a* and 6*b* are brought into mesh engagement with each other, the mesh engagement therebetween deviates by an amount corresponding to the pitch of the serration because the serration portions mesh with each other not in the same state as that when they were separated from each other.

However, the portion of the drive transmitting system between the gears formed with the serrations and the platen 1 is sufficiently decelerated, i.e., the diameter of pinion gear 6*a* is sufficiently smaller than that of gear 3, such that any deviation imparted to the position of the platen 1 by slight deviation in the engagement of serrations 7*a* and 6*a* is very small.

The positional deviation of the mesh engagement between the serration portions occurs also when automatic sheet feeding is changed over to manual sheet feeding, but the influence of such deviation of the mesh engagement can be almost neglected as described above.

The force with which the solenoid 17 is operated and the gear 7 is moved to the platen side through the pivotable lever 18 to thereby separate the gear 7 from the gear 6 may be enough to flex the spring 8 and therefore, the solenoid utilized may be of a small output, which leads to the possibility of greatly saving the electric power.

Another embodiment of the present invention will now be described.

The embodiment which will hereinafter be described is such that both of drive force transmitting means and restraining force transmitting means can be selectively connected and disconnected.

Figure 4:
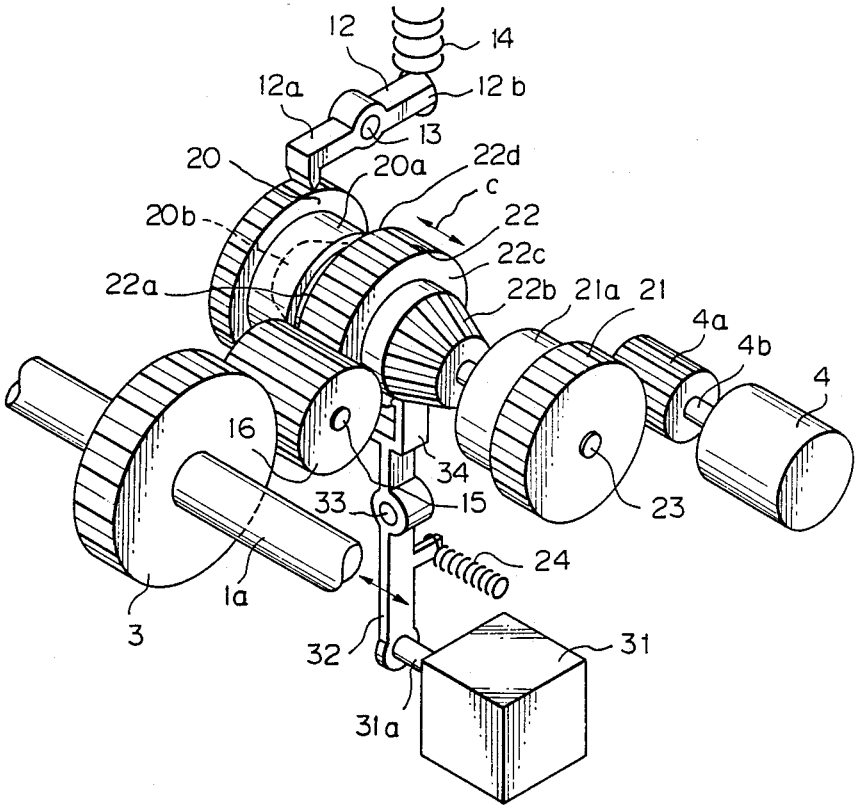
FIG. 4 is a perspective view of a sheet conveying device to which another embodiment of the present invention is applied.
Figure 5:
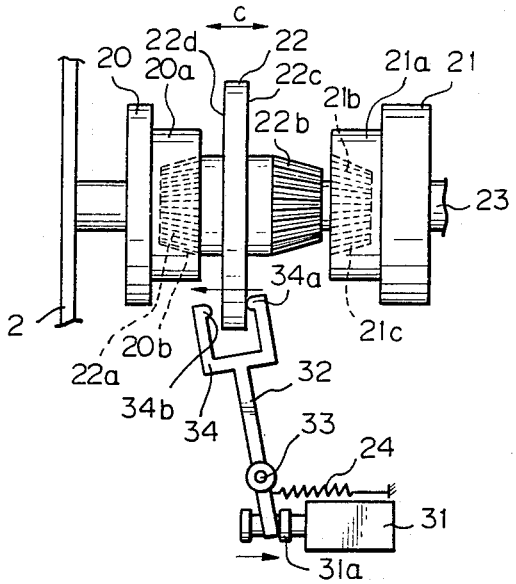
FIG. 5 is a side view showing the state of the same device during manual sheet feeding.
Figure 6:
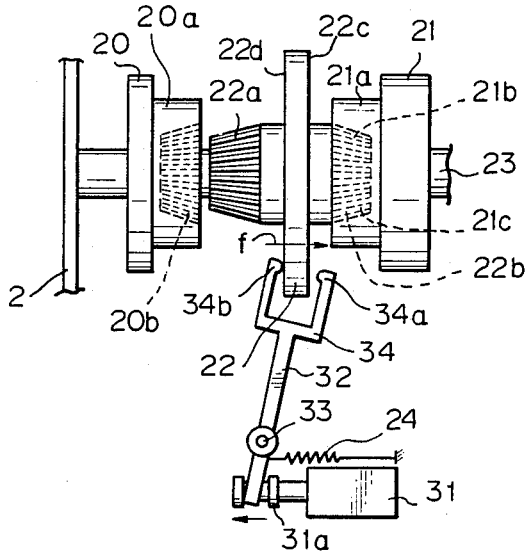
FIG. 6 is a side view showing the state of the same device during automatic sheet feeding.

FIG. 4 is a perspective view of a sheet conveying device to which said another embodiment of the present invention is applied, FIG. 5 is a side view showing the state thereof during manual sheet feeding, and FIG. 6 is a side view showing the state thereof during automatic sheet feeding.

In the present embodiment, members functionally similar to those in the previous embodiment are given the same reference numerals. Also, in FIG. 4, the platen 1, the side plates 2, the manually operated knob 30 and the sheet S are not shown because they are identical to those shown in FIG. 1.

Referring to FIGS. 4–6, a gear 4*a* is fixed to the output shaft 4*b* of a motor 4 and meshes with a gear 21 supported on a shaft 23 extending from the side plate (not shown) and parallel to a platen shaft 1*a*.

A pinion gear 21*a* is formed integrally with the gear 21.

A frusto-conical space 21*c* (as shown in FIGS. 5 and 6), gradually reduced in diameter toward the gear 21 is formed inside the pinion gear 21*a*, and a serration 21*b* is formed on the inner peripheral surface of the space 21*c*.

Also, inside the gear 21 and the side plate, a gear 22 is fitted on the shaft 23 so as to be rotatable and slidable (in the directions of bilateral arrow C).

Frusto-conical serration portions 22*a* and 22*b* are integrally formed on the opposite sides of the gear 21.

The serration portion 22*b* can mesh with a serration portion 21*b* formed on the inner peripheral surface of the pinion gear 21*a*. The other serration portion 22*a* can mesh with a serration portion 20*b* formed on the inner peripheral surface of a pinion gear 20*a* integral with a detent gear 20. The ratchet 12*a* of the detent lever 12 is in mesh engagement with the detent gear 20. The gear 22 is in mesh engagement with a gear 16 supported on the side plates (not shown) through a shaft 15. The gear 16 is in mesh engagement with the gear 3.

On the other hand, a solenoid 31 is fixed below the above-described group of gears, and the lower end of a pivotable lever 32 is pivotably connected to the end of the rod 31*a* of the solenoid 31.

The intermediate portion of the pivotable lever 32 is pivotably supported on the fixed portion of the device through a shaft 33, and a U-shaped portion 34 is formed at the upper end of the pivotable lever 32, as shown in FIGS. 5 and 6. This U-shaped portion 34 can bear against either one of the opposite sides 22*c* and 22*d* of the gear 22. A tension spring 24 is secured to the lower portion of the lever 32 and biases the lever 32 in a counter-clockwise direction.

Operation of the present embodiment constructed as described above will now be described.

Where sheet feeding is to be effected by manually rotating the platen, the supply of electric power to the solenoid 31 is cut off as shown in FIG. 5. In this case, the lever 32 is biased the counter-clockwise direction by the biasing force of the spring 24, and the protrusion 34*a* of the U-shaped portion 34 moves the gear 22 toward the gear 20. So, the serration portions 20*b* and 22*a* come into engagement with each other. Accordingly, the restraining force of the detent lever 12 is transmitted to the gears 20, 20*a*, 22, 16 and 3, and the platen (not shown) is rotated under the influence of the detent force by a knob (not shown) being manually turned. In this case, the gear 22 and the gear 21 are disconnected from each other and the rotation of the gear 3 is not transmitted to the motor 4.

On the other hand, where automatic feeding of the sheet S is to be effected by the utilization of the motor 4, the solenoid 31 is operated. The actuated of the motor 4 and the solenoid 31 is accomplished, for example, by a signal produced by depressing a return key or a line feed key, or a signal produced when a line feed code is detected in the processing.

When the solenoid 31 is actuated, the rod 31*a* is retracted as shown in FIG. 6 and the pivotable lever 32 is pivoted in the clockwise direction (in the direction of arrow f).

As a result, the upper end of the pivotable lever 32 pushes the side 22*d* of the gear 22 by means of the protrusion 34*b* thereof and therefore, the gear 22 is moved toward the gear 21 and the serration portions 22*b* and 21*b* come into engagement with each other.

So, the drive force of the motor 4 is transmitted to the gears 4*a*, 21, 21*a*, 22, 16 and 3 to thereby rotate the platen.

As the result of the serration portions 22*b* and 21*b* coming into engagement with each other, the serration portions 20*b* and 22*a* are separated from each other and the gear 20 and the gear 22 are separated from each other.

In this state, the rotation restraining force of the ratchet 12*a* of the detent lever 12 through the detent gear 20 is not transmitted to the gear 3 on the platen shaft 1*a*. Accordingly, the motor 4 is not subjected to the influence of the restraining force of the detent when it rotates the platen.

Thus, in the present embodiment, during automatic feeding, the motor 4 may put out a force necessary to drive the platen without being subjected to the influence of the restraining force. Also, during manual feeding, the platen may be manually operated against the load of the platen and the load by the restraining force without being subjected to the influence of the drive source, for example, the influence of the stationary residual torque in a case where the motor is a pulse motor, and the platen can be driven by a small force.

The platen is not limited to the roller shown in the embodiments, but may be any rotational member capable of conveying the sheet, such as a belt passed over pulleys. The means for displacing the gears is not limited to the solenoid shown in the embodiments, but may also be a plunger or the like.

As described above, the present invention provides a sheet conveying device which is capable of automatic sheet feeding and manual sheet feeding and in which, during automatic feeding, the detent force does not provide a load.

I claim:

1. A sheet conveying apparatus for conveying a sheet, said apparatus comprising:

a first rotatable member for conveying a sheet;

a driving source for driving said first rotatable member;

driving force transmitting means for transmitting a driving force of said driving source to said first rotatable member so as to rotate said first rotatable member by said driving force of said driving source, said driving force transmitting means having a second rotatable member rotatable around an axis different from a rotation axis of said first rotatable member;

a manual operating member for manually operating said first rotatable member;

detent means for producing a rotation restraining force of said first rotatable member;

restraining force transmitting means for transmitting a restraining force from said detent means to said driving force transmitting means, said restraining force transmitting means being rotatably supported on the same axis as said second rotatable member and having a third rotatable member shiftable between a first position for contacting and transmitting said restraining force to said second rotatable member and a second position being apart from and not for transmitting said restraining force to said second rotatable member; and connecting-disconnecting means for normally holding said third rotatable member at said second position and moving said third rotatable member to said first position only when said first rotatable member is rotated by said manual operating member and positioning said third rotatable member at second position when said first rotatable member is driven by said driving source.

2. A sheet conveying apparatus according to claim 1, wherein said connecting-disconnecting means includes a solenoid.

3. A sheet conveying apparatus according to claim 1, wherein said manual operating member has a knob secured to a shaft integral with said first rotatable member.

4. A sheet conveying apparatus according to claim 1, wherein said third rotatable member has a first gear and said second rotatable member has a second gear, said first gear having on a side thereof a first engaging portion substantially conically projected in the direction of the axis of rotation and said second gear having on a side thereof a second engaging portion substantially conically recessed in the direction of the axis of the rotation so as to engage with said first engaging portion, said first and second engaging portions having intermeshing serrations for engagement with each other, and wherein connecting-disconnecting means selectively effects engagement and disengagement of said first and second gears by an electromagnetic force.

5. A sheet conveying apparatus according to claim 4, further comprising spring means for biasing said first and second engaging portions into engagement, and wherein, the spring bias of said spring means is overcome by the electromagnetic force, to release the engagement of said first and said second engaging portion when said first rotatable member is driven by said driving source.

6. A sheet conveying apparatus according to claim 1, wherein said second and third rotatable members have a gear.

* * * * *

UNITED STATES PATENT AND TRADEMARK OFFICE

CERTIFICATE OF CORRECTION

PATENT NO. 4,976,557

DATED December 11, 1990

INVENTOR(S) Yoshio Uchikata

It is certified that error appears in the above-identified patent and that said Letters Patent is hereby corrected as shown below:

[57] Abstract:

Line 3, "shet" should read --sheet--.

COLUMN 1:

Line 46, "shaft" should read --shaft,--.

Line 64, "with" should be deleted.

COLUMN 5:

Line 42, "Also" should read --Also,--.

COLUMN 7:

Line 15, "actuated" should read --operation--.

UNITED STATES PATENT AND TRADEMARK OFFICE

CERTIFICATE OF CORRECTION

PATENT NO. 4,976,557 Page 2 of 2

DATED December 11, 1990

INVENTOR(S) Yoshio Uchikata

It is certified that error appears in the above-identified patent and that said Letters Patent is hereby corrected as shown below:

COLUMN 8:

Line 27, "normally hold-" should read --positioning--.

Line 28, "ing" should be deleted; and "second" should read --first--.

Line 29, "and moving said third rotatable member to" should be deleted.

Line 30, "said first position only" should be deleted.

Line 33, "second position" should read --said second position--.

Line 61, "portion" should read --portions--.

Signed and Sealed this

Sixth Day of October, 1992

*Attest:*

DOUGLAS B. COMER

*Attesting Officer*

*Acting Commissioner of Patents and Trademarks*